US008608167B2

(12) United States Patent
Raymond

(10) Patent No.: US 8,608,167 B2
(45) Date of Patent: Dec. 17, 2013

(54) POLE ASSEMBLY FOR FLYING DISK GAME

(76) Inventor: Timothy J. Raymond, West Chicago, IL (US)

( * ) Notice: Subject to any disclaimer, the term of this patent is extended or adjusted under 35 U.S.C. 154(b) by 75 days.

(21) Appl. No.: 12/843,025

(22) Filed: Jul. 24, 2010

(65) Prior Publication Data

US 2011/0042901 A1 Feb. 24, 2011

Related U.S. Application Data

(60) Provisional application No. 61/228,439, filed on Jul. 24, 2009.

(51) Int. Cl.
*A63B 67/06* (2006.01)

(52) U.S. Cl.
USPC ..... 273/348; 116/222

(58) Field of Classification Search
USPC ..... 273/398–402, 336–339, 348; 116/222
See application file for complete search history.

(56) References Cited

U.S. PATENT DOCUMENTS

| | | | | | |
|---|---|---|---|---|---|
| 722,220 | A | | 3/1903 | Finney | |
| 2,365,513 | A | * | 12/1944 | Bartle et al. | 273/339 |
| 2,890,052 | A | * | 6/1959 | Burrell | 273/375 |
| 3,428,319 | A | | 2/1969 | Engle | |
| 3,862,758 | A | | 1/1975 | McLamb et al. | |
| 4,330,130 | A | | 5/1982 | Carr | |
| 4,378,944 | A | | 4/1983 | Johnston | |
| 4,386,779 | A | | 6/1983 | Whitlock | |
| 4,736,955 | A | | 4/1988 | Pollock | |
| 4,898,392 | A | * | 2/1990 | Goletz | 273/336 |
| 5,025,748 | A | * | 6/1991 | Pettis | 116/222 |
| 5,358,255 | A | * | 10/1994 | Jolson | 273/400 |
| 5,397,130 | A | * | 3/1995 | Brown | 273/348 |
| 5,893,809 | A | * | 4/1999 | Coats et al. | 473/479 |
| 6,494,455 | B1 | * | 12/2002 | Headrick | 273/400 |
| 6,889,982 | B1 | * | 5/2005 | Gove | 273/343 |
| 6,899,336 | B2 | | 5/2005 | Michelet et al. | |
| 7,360,767 | B2 | | 4/2008 | Merccica | |
| 2005/0272515 | A1 | * | 12/2005 | Hurley et al. | 473/173 |
| 2006/0103072 | A1 | * | 5/2006 | Mercieca | 273/348 |
| 2007/0212973 | A1 | | 9/2007 | Brockes | |
| 2008/0224409 | A1 | * | 9/2008 | Marshall et al. | 273/348 |
| 2009/0291782 | A1 | * | 11/2009 | Hinn | 473/470 |

FOREIGN PATENT DOCUMENTS

| | | | | |
|---|---|---|---|---|
| WO | WO 2009038299 A1 | * | 3/2009 | A63B 57/00 |

* cited by examiner

*Primary Examiner* — Mark Graham
(74) *Attorney, Agent, or Firm* — Erickson Law Group, PC

(57) ABSTRACT

A game apparatus which allows for a target disposed on the top of a pole to be knocked down by a projectile. The game apparatus includes a segmented pole which can be assembled and disassembled easily via coupling mechanisms between each segment. The top segment of the pole includes a top cap where a surface on which targets can be placed, is provided. The bottom segment of the pole is connected to a base which holds the pole up. Alternatively, a stake can be coupled to the bottom segment of the pole to drive the pole into the ground directly. A scoring mechanism along the surface of the poles is provided, as well as a target illuminating device to enhance the visibility of the target. The top cap of the pole can also include illumination such that the game can be played even in low ambient light.

21 Claims, 11 Drawing Sheets

POLE ASSEMBLY FOR FLYING DISK GAME

This application claims the benefit of U.S. Provisional Application No. 61/228,439, filed Jul. 24, 2009.

TECHNICAL FIELD OF THE INVENTION

This invention relates to an apparatus for a game with an objective of knocking down a target

BACKGROUND OF THE INVENTION

Games are known that include the steps of tossing or throwing flying disks at stationary structures, such as disclosed in U.S. Pat. Nos. 4,378,944 and 7,360,767.

In U.S. Pat. No. 4,378,944, a pole includes a sharp stake end that is driven into the ground to hold the pole upright. A tethered target is held on a platform supported by the pole. In U.S. Pat. No. 7,360,767, a frusto-tetrahedral structure supports selectable target cylinders to be struck by a flying disk.

Known prior art games have been disadvantageous for one or more reasons. Prior art games may be large or bulky and are not easily portable. Other prior art games may have parts which are easily damaged or lost, thereby rendering the game unuseable Other prior art games may lack the capacity for being played in low lighting conditions, such as during night time. Some prior art games have been costly to manufacture.

The present inventor has recognized the need for a lightweight game apparatus which can be assembled and disassembled for portability and storage.

The present inventor has recognized the need for a game apparatus that can be used in low ambient light conditions.

The present inventor has recognized the need for a game apparatus with a scoring system.

SUMMARY OF THE INVENTION

The present invention provides a pole assembly that comprises a pole that is mounted on a base. The pole includes an upper surface for placement of a target. In use, a player throws or flings a game projectile, such as a flying disk, at the target to try to knock the target off of the pole.

Preferably, the pole is constructed of lightweight elements, such as a hollow plastic tube. The tube is preferably provided in tube segments that can be coupled together by a coupling mechanism. The coupling mechanism can be any suitable mechanism for connecting the tube segments, such as a threaded coupling, friction fit, pinned couplings, snap or twist fist, or pinned couplings. The coupling mechanism allows for disassembly of the pole for convenient handling and storage. A carrying bag can be provided to hold one or more pole assemblies, projectiles, and other game components.

Preferably, the pole is composed of transparent or translucent plastic. A lighting mechanism provided preferably within the pole is used to illuminate the pole in low ambient light conditions. In one embodiment, a removable cap at the end of a top tube segment is provided. The removable cap comprises a battery, one or more lighting sources, an on/off switch and the appropriate circuitry for switching the lighting source on and off. Preferably, the lighting sources comprise a plurality of LED lamps. The battery is housed beneath a battery access door on a top surface of the cap. The battery access door is screwed onto the cap top surface and is flush with surrounding portions of the top surface. An on/off switch is also located recessed on the cap top surface.

The pole assembly can further comprise a target illumination. The target illumination allows for the lighting of various targets if desired. The illumination of targets, usually transparent targets, for example a plastic bottle containing water, allows for players to recognize the target easier when playing in low ambient light conditions such as at night or in a darkened room.

When two or more poles are provided to play a game, the poles can be translucent and of different colors to designate different teams. In use, the pole is set upright through the use of a base or directly driving a stake connected to the pole into the ground. A target is set on a top surface of the cap. The target is preferably a common object such as a beverage can, a bottle or a plastic beverage container, a game ball such as a tennis ball, paint can, or any other common object that can be used as a target. The type of target can be selected based on the desired difficulty level. For example, a lightweight and/or larger target is easier to aim for and knock off the pole than a heavier/smaller target.

The players attempt to displace the target off the pole by throwing or flinging a projectile, such as a flying disk, at the target. Two pole assemblies can be set up at a distance and two players standing near to one pole assembly can take aim at a target on the opposing pole assembly, in a fashion similar to the game of horseshoes.

A scoring mechanism along the exterior surface of the pole assembly is used to keep track of each team's scores. The scoring mechanism comprises markings on the exterior surface of the pole assembly and a score indicator. The markings may be numerical such as a display of numbers on the surface of the pole segment, or notches, or any other marking which would allow a score to be kept. The score indicator can be a plastic bracket or ring which can slide up and down along the surface of the pole assembly to designate a specific marking, such as a number, to denote the score.

This invention provides a new and novel game which is inexpensive to manufacture, may be easily and quickly assembled for use and disassembled for transportation and storage. The apparatus can be made of suitable materials which provide desirable characteristics to allow the apparatus to be repeatedly used with minimal damage, and allow for ease of storage or transportation. The apparatus can be used in low ambient lighting conditions, thus allowing for games to be played at night.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1C:
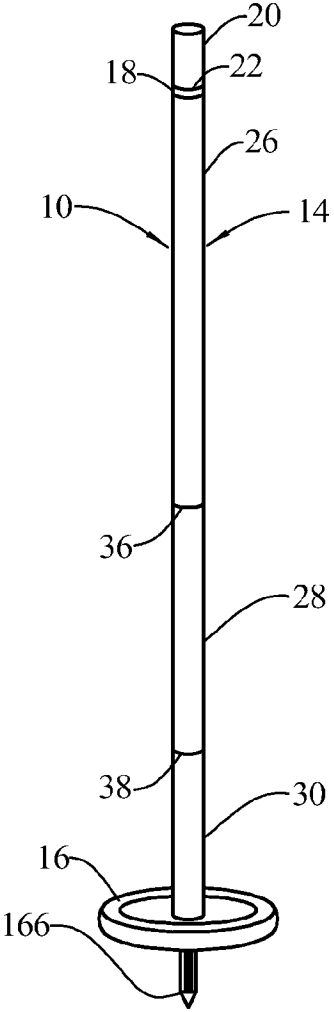
FIG. 1C is an elevation view of an alternate pole assembly of an exemplary embodiment of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIGS. 1A through 2C illustrate a pole assembly 10 that can be configured according to three exemplary embodiments of the invention. The pole assembly 10 includes a pole 14 mounted onto a base 16. A cap 18 is mounted to a top of the pole 14. The cap 18 supports a target 20 (shown dashed in FIG. 1) such as a can or a plastic bottle, on a top surface 22 of the cap. A projectile 23, such as a flying disk, known commercially as a FRISBEE, is thrown or flung at the target for the purpose of knocking the target off the pole. A stake 166 can be used with or without the base as described below.

The pole 14 can be assembled in two or more sections. In one embodiment, as illustrated in FIG. 1A, a top pole section 26 is connected to an intermediate pole section 28 that is connected to a bottom pole section 30. The bottom pole section 30 can be fitted into the base 16. The cap 18 is fitted into the top of the top pole section 26. The top pole section can be assembled to the intermediate pole section 28 by use of a coupling mechanism 36. The intermediate pole section can be attached to the bottom pole section 30 by a coupling mechanism 38. The coupling mechanism can be a friction fit, a threaded shaft, a twist-lock mechanism, a snap fit mechanism, or any other suitable mechanism. In one embodiment (FIGS. 1D and 2C), the coupling mechanism 36 and 38 can include ridges 21 that are designed to lock into the different pole sections to create a tight fit. The couplings 36 and 38 can have a center ring 17 that has a diameter that is larger than the diameter of either the top pole section 26, the intermediate pole section 28, or the bottom pole section 30, to act as an insertion stop. Additionally, it is possible that the couplings are formed as part of one member of the connecting pole sections rather than be a separate piece.

Figure 7:
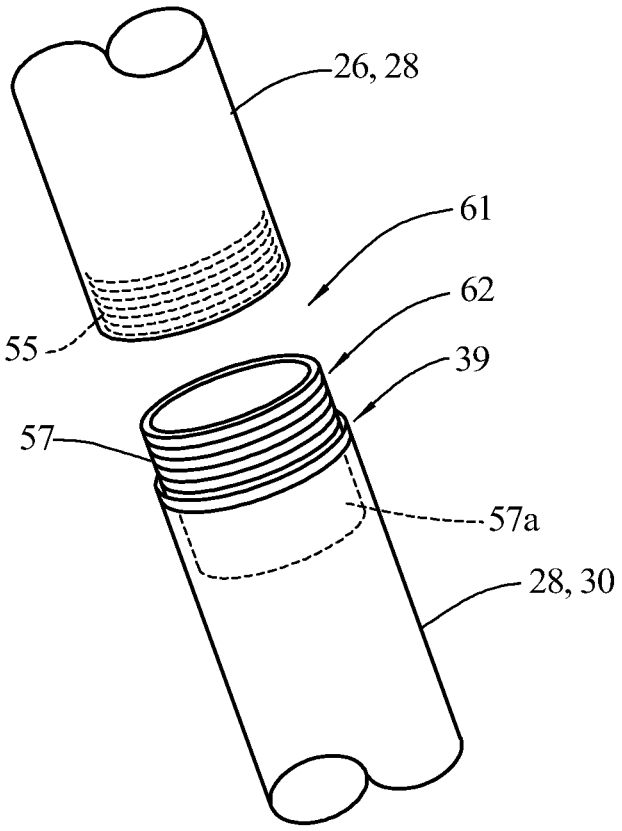
FIG. 7 is a perspective, exploded view of an alternate embodiment of the coupling mechanism of the pole assembly.

In another embodiment, as illustrated in FIG. 7, the coupling mechanism 36, 38 is replaced by a coupling mechanism 61. Preferably, the coupling mechanism 61 includes reduced diameter ends to frictionally engage or threadingly engage, or otherwise engage into the inside of the connecting pole sections in order for there to be a smooth visual transition between the outer surfaces of the connecting pole sections. The coupling mechanism 61 includes a coupling 62 that has a threaded end 57 that threads into a complementarily threaded region 55 of an adjacent respective pole segment 26, 28. The coupling 62 is provided with a reduced diameter end 57*a* for attachment to the inner surface of a respective pole section 28, 30. End 57*a* can be attached or secured to the inner surface of the pole via glue, or any other attachment mechanism suitable for use with such a threaded coupling 62.

The use of a coupling mechanism allows pole segments to be added or removed. To appeal to a broad audience of differing ages, the height of the pole can be adjusted by removing or adding pole sections. The height of the poles can also be adjusted to make the game more or less difficult.

Figure 2A:
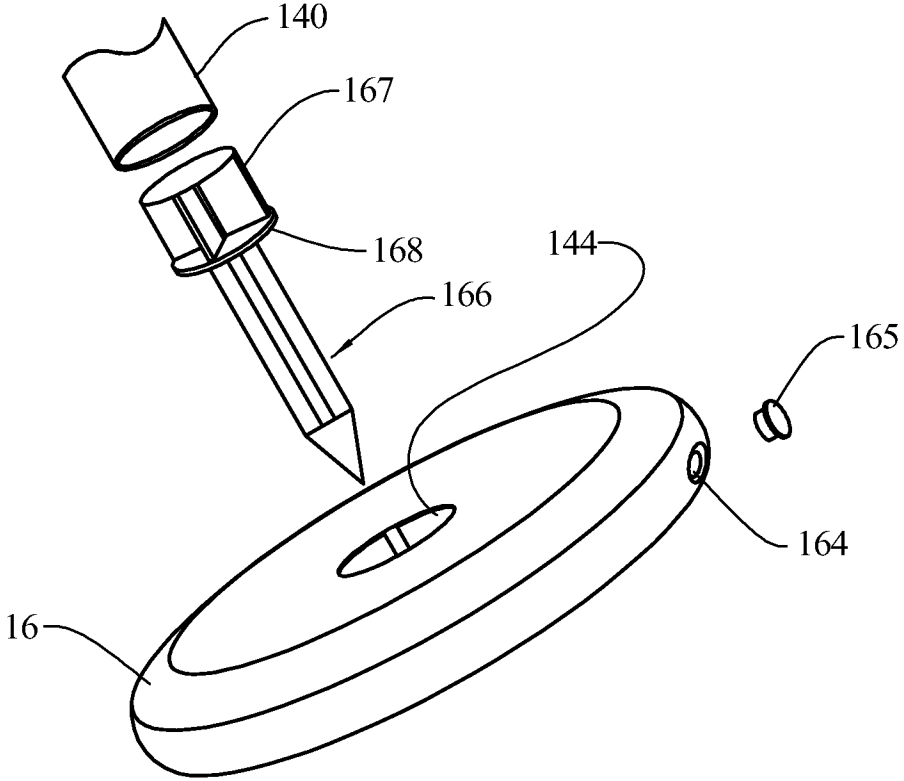
FIG. 2A is an enlarged exploded perspective view of the base of the pole assembly of FIG. 1.
Figure 2C:
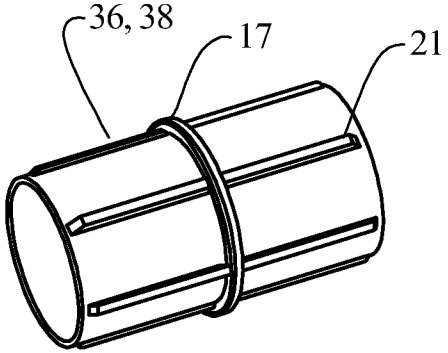
FIG. 2C is an enlarged perspective view of the coupler of the pole assembly.
Figure 2B:
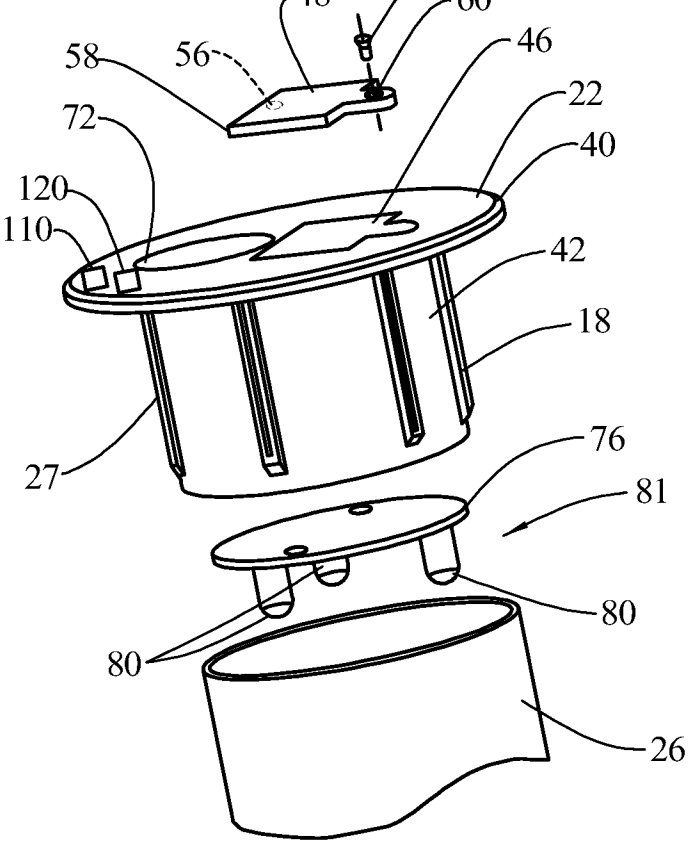
FIG. 2B is an enlarged exploded perspective view of the top cap of the pole assembly of FIG. 1.
Figure 3A:
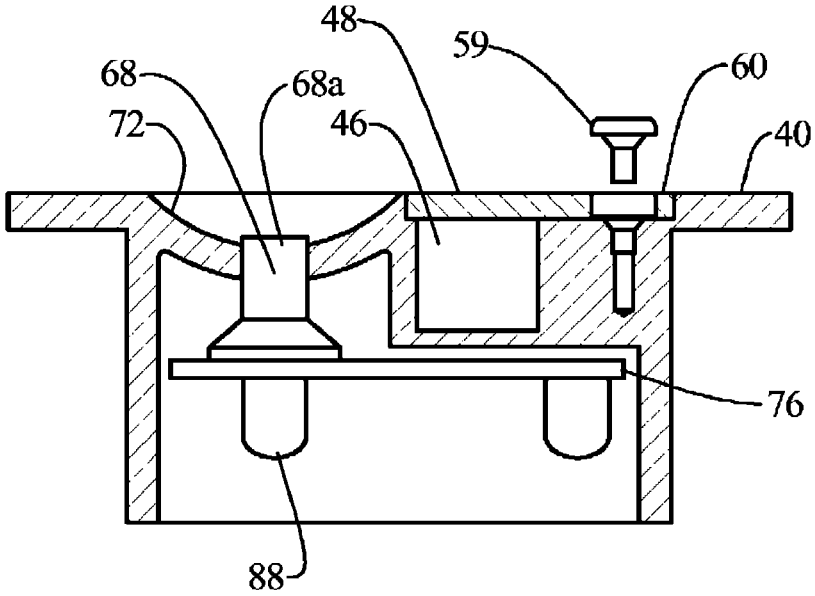
FIG. 3A is a cross sectional view of the top cap of the pole assembly.
Figure 3B:
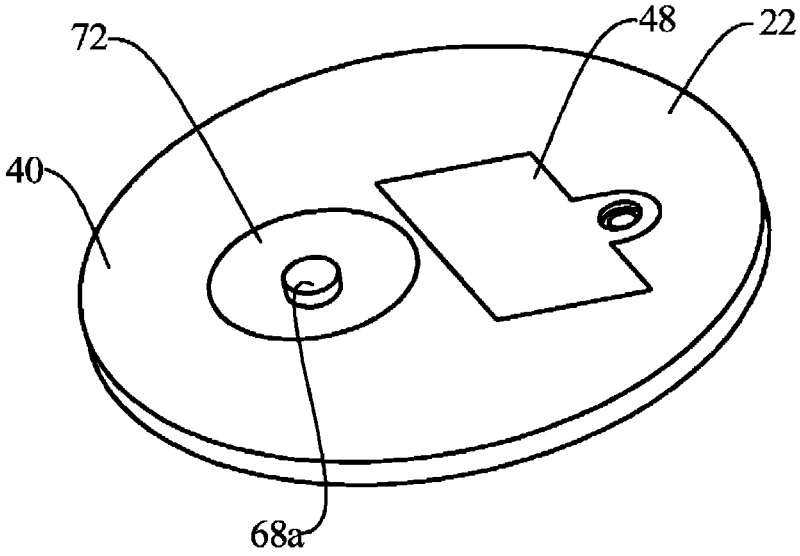
FIG. 3B is an enlarged perspective view of the top cap of the pole assembly.

FIGS. 2B, 3A and 3B illustrate the cap 18 in more detail. The cap includes a top wall 40 that provides the top surface 22. The cap provides a cylinder portion 42 that extends from the top wall 40. The cap 18 comprises a lighting mechanism 81. The lighting mechanism comprises a battery compartment 46, and a push button switch 68 (FIG. 3A). The battery compartment 46 is recessed from the top surface wall 40, and disposed within the cylinder portion 42. A door 48 encloses a battery (not shown in FIG. 2B) within the compartment 46. The door 48 is fastened to the wall 42 by two hinge lugs 56, 58 and a screw 59 inserted through a screw lug 60 and threaded into a hole in the top wall 40.

Figure 5:
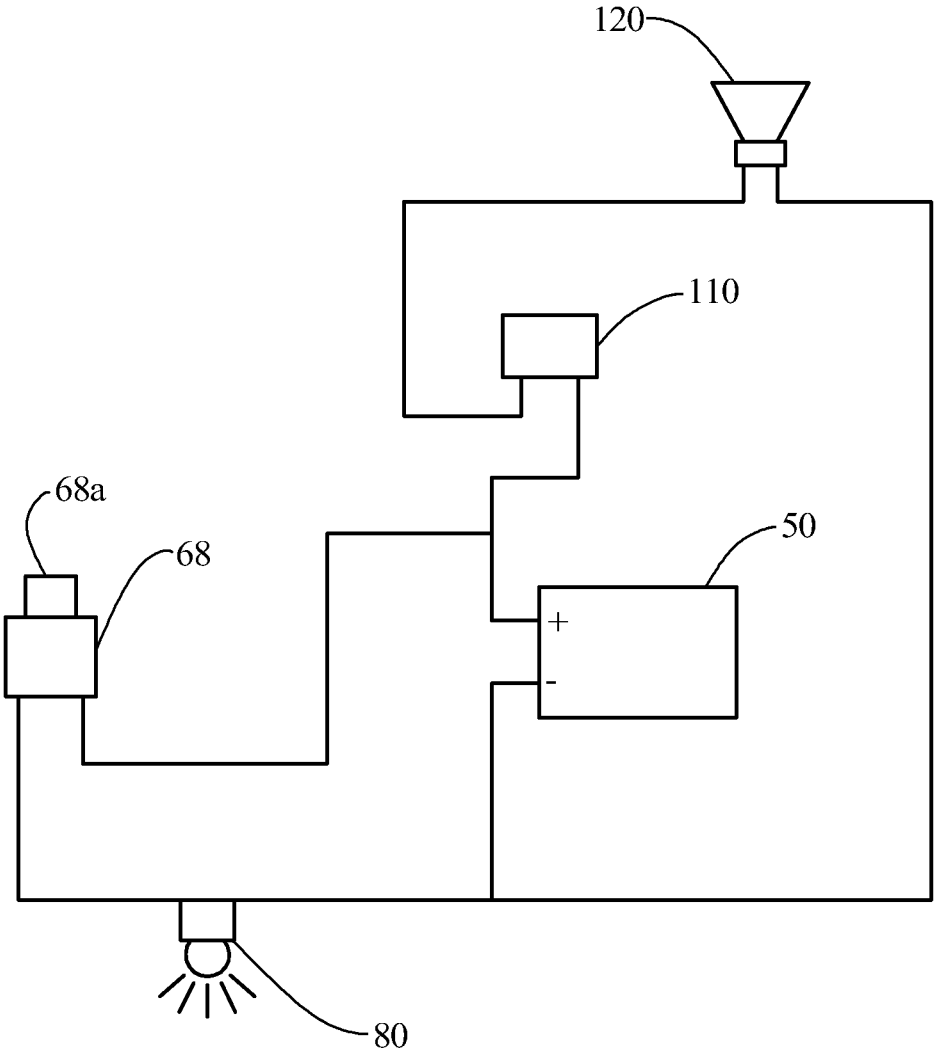
FIG. 5 is a electrical schematic of the preferred embodiment.

The push button switch 68 (shown in FIG. 3A) has a push button 68*a* accessible by a finger within a dished region 72 formed into the top surface 22. A circuit board 76 is mounted within the cap 18 to an underside of the wall 40. The circuit board mounts one or more lamps 80, such as LED lamps, which illuminate downward into the pole 14. The switch 68 is mounted on the circuit board 76. Wiring connects the switch 68, the battery 50 and the lamps 80 via the circuit board or other type lamp connector as shown in the schematic FIG. 5.

The cap 18 has an outside diameter that is slightly smaller than the inside diameter of the upper pole section 26 such that a tight friction fit is provided when the cap 18 is pressed down into the upper pole section 26. The cap can contain ridges 27 that function to create a tight fit between the cap 18 and the top pole section 26. Alternately a threaded or bayonet connection could be used to connect the parts 18, 26. The cap is removable to service the lamps 80 as needed. Alternately, the cap 18 could be permanently fixed to the upper pole section 26 by adhesive if service of the lamps is not anticipated.

Figure 9:
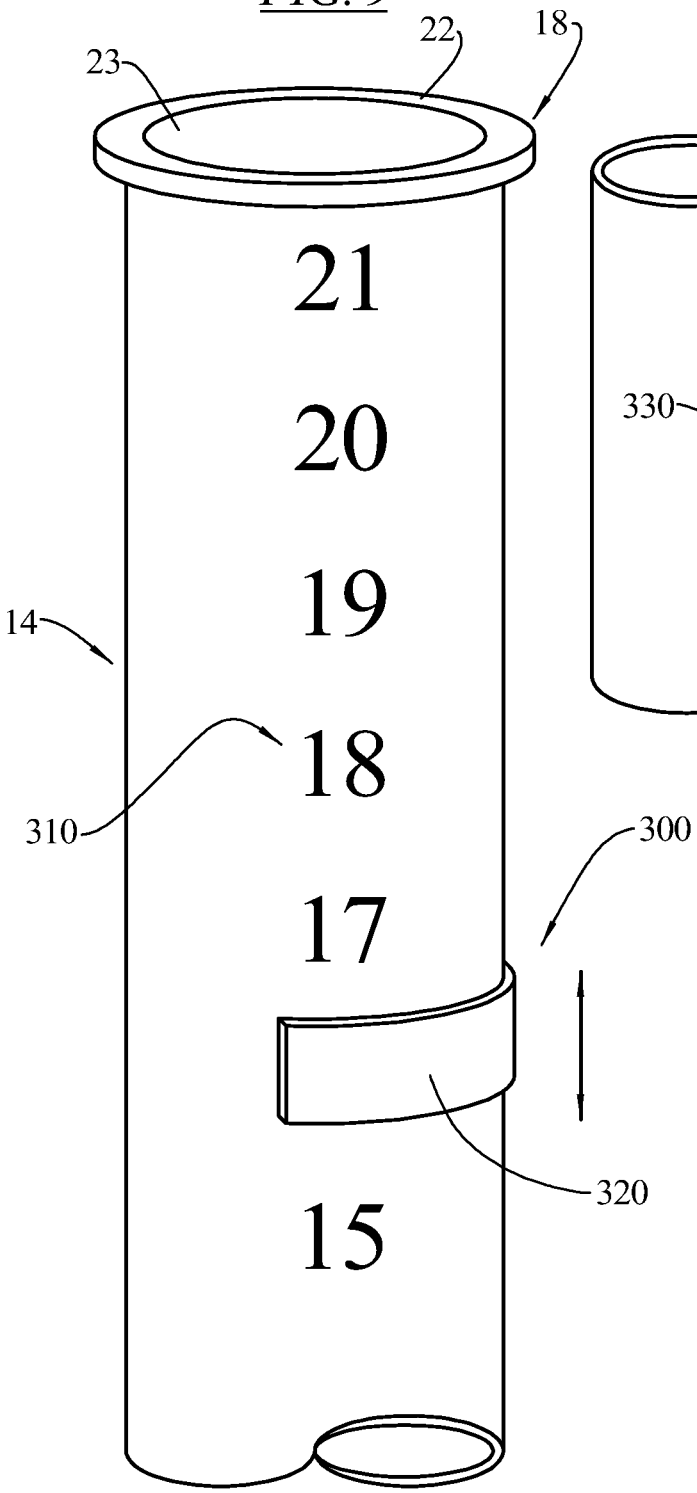
FIG. 9 is a perspective view of an embodiment of the scoring mechanism.

In one embodiment, as illustrated in FIG. 9, the top surface 22 of the cap 18 can have a central recessed region 23 to allow the top of the cap 18 to receive a target with a curved surface, such as a game ball. The battery compartment and push button as described above would be disposed further below the top surface within the recess 23.

According to one preferred embodiment, a fully extended pole 14 can be between 36 inches and 72 inches of height, and can have a diameter of between 1 and 3 inches. The fully extended pole 14 can be translucent and tinted with a variety of colors to designate opposing teams. Alternatively, if low ambient lighting conditions make it difficult to identify the color of the poles, lighting mechanisms 81 of each pole can emit light of different colors to designate opposing team colors.

The lamps 80 can be configured to remain on continuously when the switch 68 is closed or can be configured to blink for a more interesting visual effect. Additionally, a sensor 110 (shown schematically in FIGS. 2B and 5) can be incorporated into the cap which senses an impact to the pole and which then causes a visual or auditory signal to commence. For example, the lamps 80 could be illuminated or start to flash, or a buzzer 120 (shown schematically in FIGS. 2B and 5) can be provided to loudly buzz when the cap or pole is struck by the projectile.

A target 20 resting on the wall 40 can also be eliminated when the cap or pole is struck by the projectile, rather than having the projectile strike the target 20 directly. Alternately, the sensor could be an optical or movement sensor which senses the projectile passing over the cap, or passing near the cap without the projectile actually striking the cap.

Figure 4:
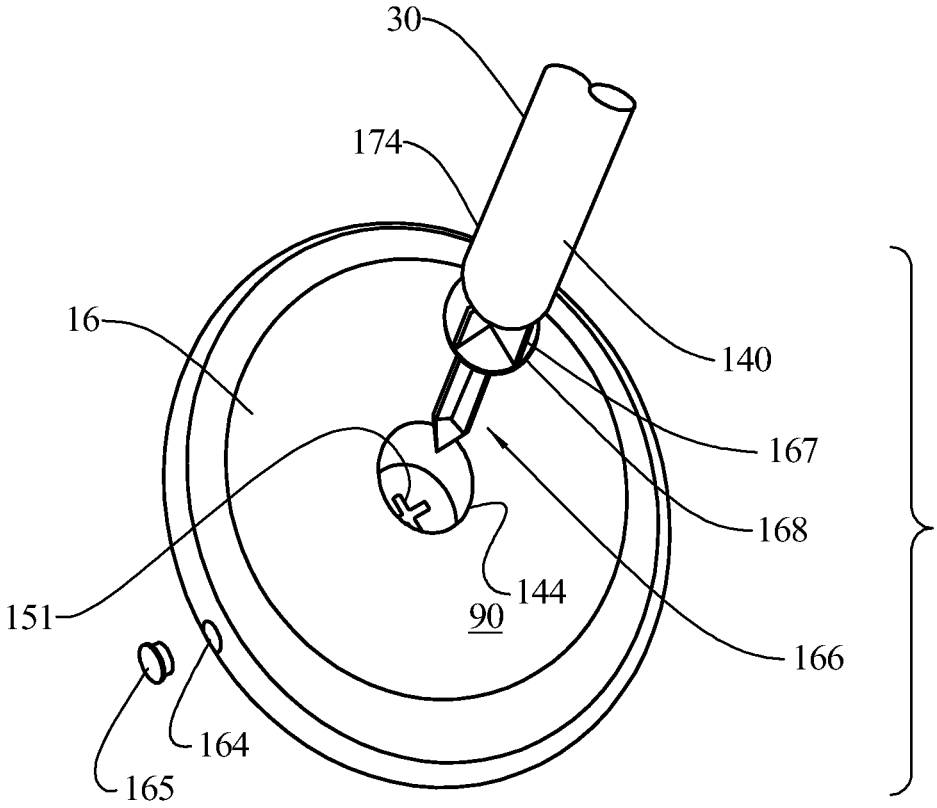
FIG. 4 is a top plan view of the base of FIG. 1.
Figure 4A:
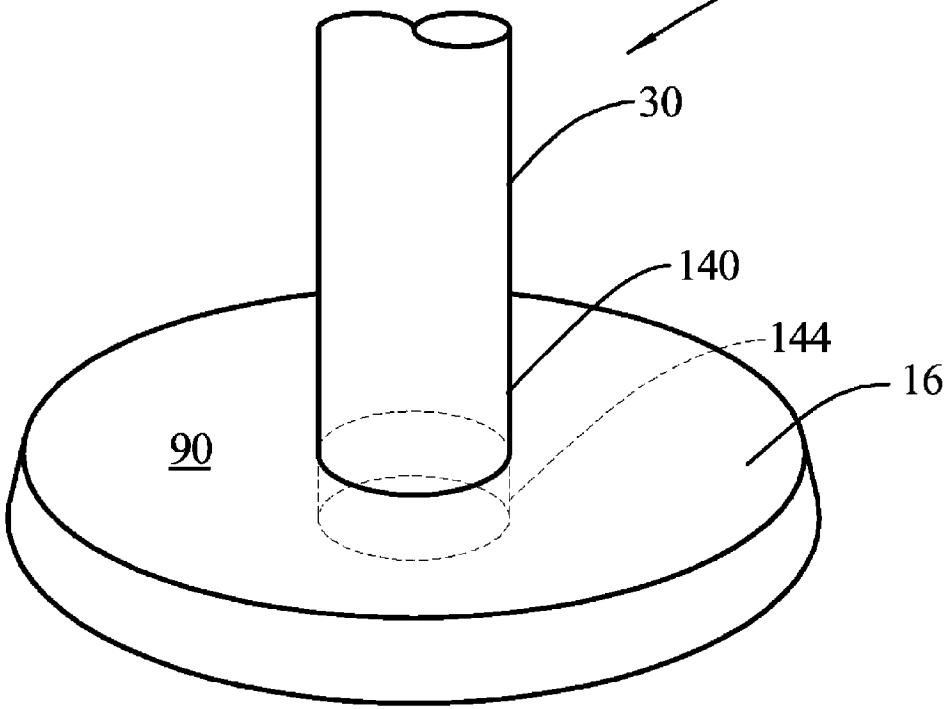
FIG. 4A is a perspective view of one method of coupling the bottom pole section to the base.

FIGS. 1A and 4A illustrate one embodiment where the base 16 is circular in shape and the pole 14 is centrally located thereon. The base 16 has an upward facing surface 90 which could have advertising or other indicia applied thereon. The base 16 is used to stabilize the bottom portion of the bottom pole section 30. The base 16 comprises a central socket 144 sized to receive the bottom portion 140 of the bottom pole section 30. The central socket 144 is sized slightly larger than the outer diameter of the bottom pole section 30, but small enough to create a frictional fit such that the bottom portion 140 of the bottom pole section 30 can be secured within the central socket 144.

Figure 1B:
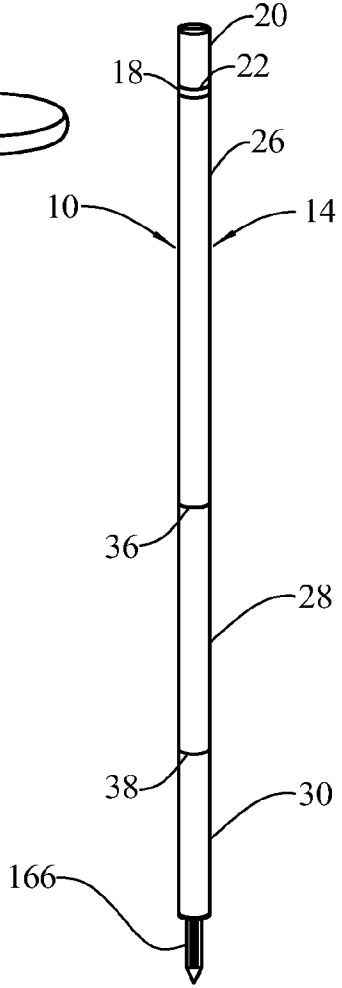
FIG. 1B is an elevation view of an alternate pole assembly of an exemplary embodiment of the invention.
Figure 1A:
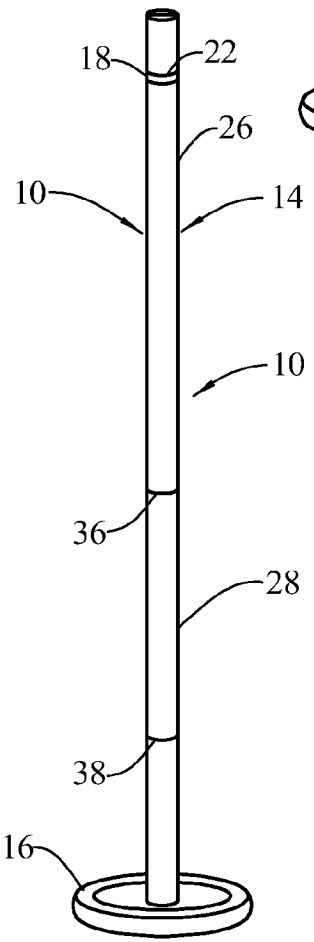
FIG. 1A is an elevation view of a pole assembly of an exemplary embodiment of the invention.
Figure 1D:
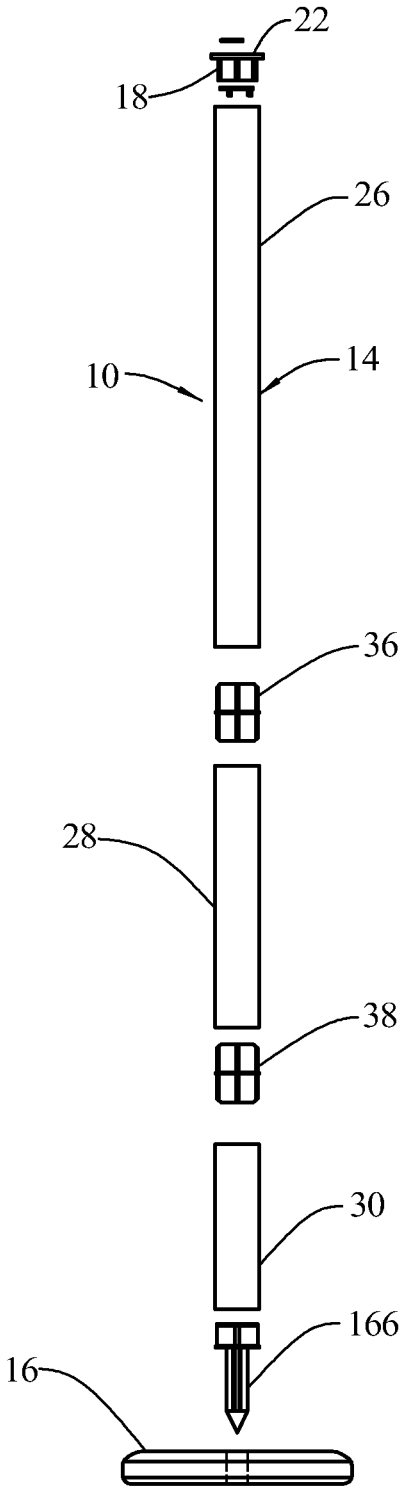
FIG. 1D is an enlarged exploded elevation view of a pole assembly of an exemplary embodiment of the invention.

FIGS. 1C and 4 illustrate an embodiment for securing the pole to the base and to the ground. As illustrated in FIG. 4, the bottom of the central socket 144 comprises a "+" shaped hole 151. The "+" shaped hole 151 is shaped to receive a "+" shaped (in transverse cross section) stake 166. The stake 166 can be provided for anchoring the assembly into soft ground with (FIG. 1C) or without (FIG. 1B) the use of the base 16. The stake 166 is shown in detail in FIGS. 2A and 4. Preferably the stake is a plastic stake with a base portion 167 and an intermediate disk 168. The base portion 167 is sized to fit within the inner diameter of bottom pole section via a coupling mechanism similar to that of coupling mechanism 36, 38 or coupling mechanism 61 as described above. When a user desires to use the stake 166, the base portion 167 is coupled to the bottom of the bottom pole section to be used alone as illustrated in FIG. 1B or in conjunction with the base 16 as illustrated in FIG. 1C, to secure the pole assembly to the ground. After the stake 166 is coupled to the bottom of the bottom pole section, the stake can be driven into the ground directly, or after passing the stake through the "+" shaped hole 151 in the base 16.

If the pole assembly is to be used where a soft surface is not available to drive the stake into, such as when using the pole assembly indoors, or in a driveway, or on a basketball or tennis court, the base 16 can be used alone without the use of the stake 166 as shown in FIGS. 1A and 4A.

For disassembly, the bottom pole section 30 can be removed from the base 16. The portion 140 could also be adhesively secured into the socket 144 or formed with the base 16 if a permanent connection is desired.

The bottom base 16 can have a diameter of approximately 12 inches and can be blow molded. The base 16 can be a substantially sealed annular disk and include a fill opening 164 for filling the base 16 with water or sand for additional stability of the pole 14. The fill opening can be on the side, top or bottom of the base and is closed with a threaded plug 165.

In use, two pole assemblies 10 can be provided, spaced apart by a pre-determined distance. Two players take positions adjacent the two pole assemblies respectively. A target is placed on the top surface 22 of each of the caps 18. Players attempt to knock over the targets adjacent to their opponent by throwing or flinging a projectile at the target. Preferably the projectile is a flying disk, such as known commercially as a FRISBEE. Alternatively, the projectile may be a game ball, or any other object suitable for use as a projectile for knocking down a target. Each pole 14 can have a distinct coloring to distinguish teams.

Figure 6:
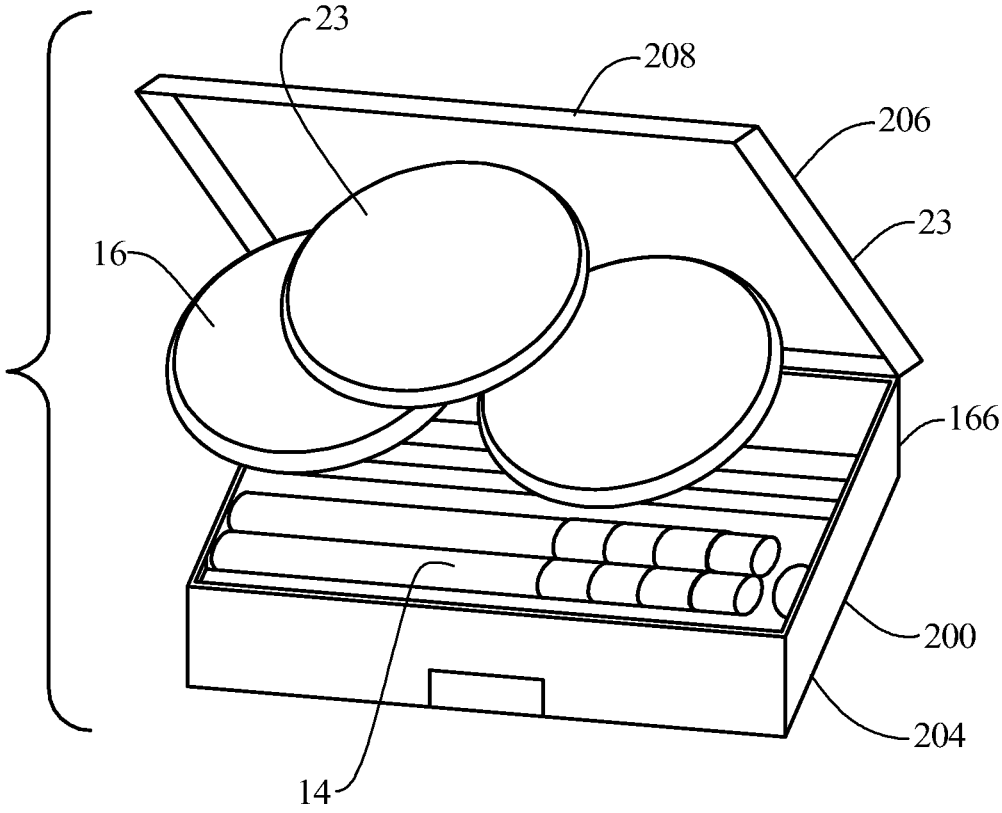
FIG. 6 is a perspective, exploded view of a game kit according to the invention.

FIG. 6 illustrates a game kit 200 that comprises a carrying case 204 with an openable lid 206. The lid is preferably clear PVC and the carrying case is preferably opaque Nylon. A zipper 208 is applied around the lid to close the lid all around the opening of the carrying case. The case 204 is sized to hold two disassembled pole assemblies 14, two flying disks 23, two bases 16 (one shown) and two stakes 166.

Figure 8:
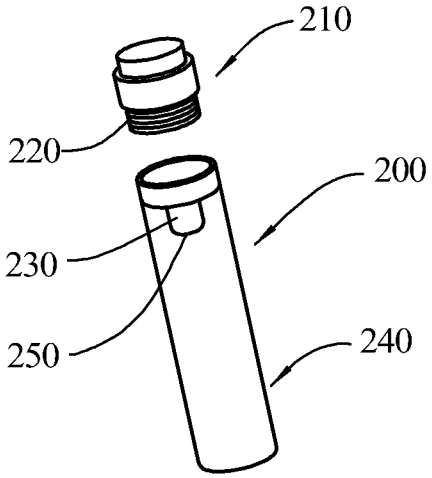
FIG. 8 is a perspective, exploded view of an embodiment of the target illumination.

FIG. 8 illustrates a target illumination device which can be provided as a further component of the poles assembly. Where the target is translucent, a target illumination device 200 is used to light up the target such that the visibility of the target is enhanced. The target illumination device may be cylindrically shaped to fit within various targets, such as a water bottle filled with water. The device 200 can be a closed cylinder with a removable top cap 210 described below. The target illumination device can be made out of plastic or other suitable material which allows a light source 230 to be transmitted through a lighted region 240 of the illumination device. The illumination device thus acts as a glow stick which can be disposed within a target. Light source 230 may be an LED or other suitable illumination disposed with a pocket 250 shaped to receive the light source 230 at the top of the lighted region. The light source is powered by a battery (not shown) such as a flat watch battery disposed within the top cap 210 of the target illumination device. The top cap can be connected to the lighted region 240 via a threading mechanism 220. To supply power to the light source 230, the top cap can be screwed to the top of the lighted region until the battery makes contact with an electrical contact in communication with the light source 230. The target illumination device may be of varying colors to allow for targets to emanate different color lights for a dramatic visual effect, or to indicate opposing team targets.

In one embodiment, the pole assembly further comprises scoring mechanism. As illustrated in FIG. 9, a scoring mechanism can be displayed along the surface of at least one pole segment. As shown, the scoring mechanism is displayed along the top pole section. The scoring mechanism 300 comprises scoring indicia 310, and a score indication 320. The scoring indicia 310 as illustrated is a numerical display of numbers which can correspond to points scored. The score indicator can be moved along the surface of the pole segment upwards and downwards as indicated by the double headed arrow. The scoring indicator can be moved to a number to indicate the score as points are accumulated. The scoring indicator can be a ring, a c-shaped clip or a bracket which is disposed in contact with at least a portion of the circumference of the pole segment. The scoring indicator is sized such that it is slideably adjustable up and down along the surface of the pole segment, yet sized to form a sufficient friction fit such that the scoring indicator 320 will not slide off, or fall off the pole segment. The indicator shown is a resilient plastic c-shaped clip that is slightly spread open to grip the outside surface of the pole to remain stationary on the pole, but is vertically slidable with force to change the indicated score.

Figure 10:
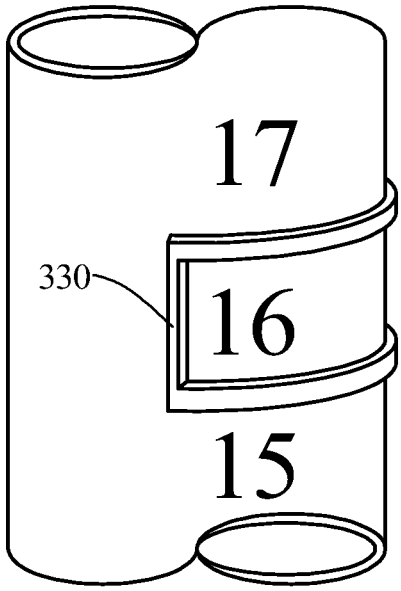
FIG. 10 is a perspective view of a second embodiment of the scoring mechanism.

FIG. 10 illustrates a resilient c-shaped clip score indicator 330 which allows for the score to be viewed through the scoring indicator. Scoring indicia may also be notches or other markings which can be used to indicate a team's performance. To keep score when the scoring indicia is a notch, the score indicator can be moved up with each successful removal of a target until the top notch is reached. Alternatively, scoring indicia may be a color system, where for example, colors of the rainbow are used to designate levels.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein, except where inconsistent with the present disclosure.

The invention claimed is:

1. A target support for a game with an objective of knocking down a target, comprising:

a segmented pole comprising a plurality of segments, the plurality of segments comprising an upper pole segment and a lower pole segment connected with at least one coupling mechanism, the segmented pole comprising a translucent or transparent wall;

a top cap disposed adjacent a top of the upper pole segment and comprising a support surface for supporting the target;

at least one of the segmented pole or the top cap comprises a light source configured to illuminate through the translucent or transparent wall of the segmented pole;

a pole support attached to the pole opposite the top cap and configured to secure the pole in an upright position;

a scoring mechanism comprising a scoring indicator movable along the pole to a plurality of scoring indicia located on the pole;

the plurality of scoring indicia are located on the translucent or transparent wall of the segmented pole, the light source is arranged to backlight the scoring indicia.

2. The target support of claim 1, wherein plurality of segments comprises one or more intermediate segments between the upper pole segment and the lower pole segment, wherein the at least on coupling mechanism comprises a plurality of coupling mechanisms, wherein the intermediate segments are joined to each other and to the upper pole segments and lower pole segments with one of the plurality of coupling mechanism at adjacent pole segments.

3. The target support of claim 1, wherein the coupling mechanism comprises a frictional fit connection or thread-screw connection at adjacent segments of the pole.

4. The target support of claim 1, comprising a light circuit, the light circuit comprising the light source, the light circuit having at least two user selectable modes of lighting comprising continuous lighting and intermittent lighting.

5. The target support of claim 1, wherein the pole comprises an impact sensor configured to detect an impact to the pole or the target and to illuminate the light source in response to the detected impact.

6. The target support of claim 1, wherein the support surface of the top cap comprises a recessed region.

7. The target support of claim 1, further comprising a target illumination device configured to be placed in or about the target for illuminating the target.

8. The target support of claim 1, wherein the pole support is a stake for driving into the ground.

9. The target support of claim 1, wherein the pole support comprises a base plate with a socket suitable for receiving the lower pole segment.

10. The target support of claim 1, wherein the entire segmented pole is transparent or translucent.

11. The target support of claim 1, comprising a light circuit, the light circuit comprising the light source, a power source, an activation switch, and, the wherein the support surface of the top cap has a recessed region, the activation switch is located in the recessed region; the top cap comprises a cylinder portion extending from the upper surface and friction fittable within a top hollow portion of the pole; the light source is positioned to direct light direct light downward into the pole.

12. The target support of claim 1, wherein the top cap comprises the light source; the top cap comprises a cylinder portion extending from the upper surface and friction fittable within a top hollow portion of the segmented pole; the light source is positioned to direct light downward into the pole.

13. A method of playing a target knock down game, comprising the steps of:

assembling a segmented pole to a desired height by connecting at least two pole segments using a coupling mechanism;

securing the segmented pole in an upright position;

disposing a target on a top surface of the segmented pole;

backlighting, with a light source, a plurality of scoring indicia located on a translucent or transparent wall of the pole;

aiming and tossing a projectile towards the target;

sliding a scoring indicator, which has a shape that resiliently grips the outer surface of the pole to bias the scoring indicator against removal from the pole and to retain the scoring indicator slidably friction fitted to the pole during the sliding, to at least one of the plurality of scoring indicia on the pole by overcoming the friction fit between the scoring indicator and the pole when the target is knocked off the segmented pole to reflect an award of one or more points to a person or a team of persons who knocked the target off the segmented pole; and, maintaining surface to surface contact between the scoring indicator and the pole during the sliding.

14. The method of claim 13, comprising the step of detecting an impact to the pole with an impact sensor and illuminating a light source in the pole in response to the detected impact.

15. The method of claim 13, comprising the step of detecting an impact to the pole with an impact sensor and activating an auditory device within the pole to produce a sound in response to the detected impact.

16. The method of claim 13, comprising the step of detecting an impact to the target via the pole with an impact sensor in the pole and flashing the light source on and off in response to the detected impact.

17. The method of claim 13, wherein the step of sliding comprises the step of positioning the scoring indicator at one of the plurality of scoring indicia so that the scoring indicia is between a first edge and a second edge of the scoring indicator where the first edge of the scoring indicator is adjacent to a first side of the scoring indicia and the second edge of the scoring indicator is adjacent to a second side of the scoring indicia, and the scoring indicator is C-shaped and extends around the pole.

18. The method of claim 13, wherein scoring indicator is resiliently c-shaped and wherein the step of assembling comprises the step of spreading open the c-shaped scoring indicator to attach the scoring indicator to the circular pole and allowing the resilient c-shaped scoring indicator grip the outside surface of the pole.

19. A target supporting pole apparatus for a game with an objective of knocking down a target comprising:

a pole configured to be supported in an upright position, the pole comprising a top surface configured to support the target;

the pole comprising a scoring mechanism, the scoring mechanism comprising a scoring indicator movable along an indicator path along a scoring length of the pole to a plurality of scoring indicia located along the scoring length of the pole;

the indicator path being free of projections that would impede the movement of the scoring indicator along the indicator path; and, the pole comprises a light source that is arranged to direct light through an exterior surface of the pole and to back-light the scoring indicia.

20. The target supporting pole apparatus of claim 19, wherein the scoring indicator is slidably friction fitted to the pole.

21. The target supporting pole apparatus of claim 19, wherein the scoring indicator is C-shaped and the pole is circular, the scoring indicator has a first edge, an opposite second edge, and a scoring gap between the first edge and second edge for receiving the scoring indicia therein.

* * * * *